US010467831B1

(12) United States Patent
Chen

(10) Patent No.: US 10,467,831 B1
(45) Date of Patent: Nov. 5, 2019

(54) CLOUD-BASED ACCESS CONTROL SYSTEM

(71) Applicant: GIGATECH R&D CORP., New Taipei (TW)

(72) Inventor: Tsung-Peng Chen, New Taipei (TW)

(73) Assignee: GIGATECH R&D CORP., New Taipei (TW)

( * ) Notice: Subject to any disclaimer, the term of this patent is extended or adjusted under 35 U.S.C. 154(b) by 0 days.

(21) Appl. No.: 16/019,499

(22) Filed: Jun. 26, 2018

(51) Int. Cl.
*G07C 9/00* (2006.01)

(52) U.S. Cl.
CPC ..... *G07C 9/00103* (2013.01); *G07C 9/00031* (2013.01); *G07C 9/00111* (2013.01); *G07C 9/00309* (2013.01); *G07C 9/00571* (2013.01); *G07C 9/00904* (2013.01); *G07C 2009/00769* (2013.01)

(58) Field of Classification Search
CPC ..... G07C 9/00103; G07C 9/00031; G07C 9/00111; G07C 9/00309; G07C 9/00571; G07C 9/00904
See application file for complete search history.

(56) References Cited

U.S. PATENT DOCUMENTS

2014/0240087 A1* 8/2014 Liu ..... G07C 9/00103 340/5.54
2016/0328896 A1* 11/2016 Zheng ..... G07C 9/00
2017/0193723 A1* 7/2017 Park ..... E05B 47/00
2019/0088059 A1* 3/2019 Santhosh ..... G07C 9/00904

* cited by examiner

*Primary Examiner* — Nabil H Syed
(74) *Attorney, Agent, or Firm* — Leong C. Lei

(57) ABSTRACT

The cloud-based access control system includes a mobile application program and a door unit. The mobile application program has a first identification code, a scanning sub-program, and a receiving sub-program. The door unit includes a camera unit and a two-dimensional code generation unit for capturing a first image and producing a two-dimensional code where a second identification code is encoded. The first image and the second identification code are transmitted to a cloud server. The second identification code may be obtained by the scanning sub-program. The first and second identification codes are transmitted by the mobile application program to a pairing unit of the cloud server for authentication. When the first and second identification codes are matched, the cloud server sends the first image and the second identification code to the receiving sub-program for visual confirmation and an electronic lock may be selectively unlocked.

20 Claims, 8 Drawing Sheets

CLOUD-BASED ACCESS CONTROL SYSTEM

BACKGROUND OF THE INVENTION

(a) Technical Field of the Invention

The present invention is generally related to access control systems, and more particular to an access control system for a residential community.

(b) Description of the Prior Art

Various access control systems have long been adopted in residential communities. The ID cards or security cards recognize only the cards, not the card holders. Voice intercoms provide only limited identifiability. Video intercoms require large bandwidth and high maintenance. Moreover, there lacks a common communication standard among the various products. Once a product is defective or phased out, it is difficult to find a replacement. This is why the access control systems for many communities are often out of order, the access control is slack, and criminal activities shift from street corners into communities.

Conventional analog or digital intercoms require cable layout to connect the door units with the indoor units. These cables often run across public areas. There are often disputes about who should be responsible for the maintenance, the residents or the home association of the community.

SUMMARY OF THE INVENTION

To obviate the above shortcomings, the present invention teaches a cloud-based access control system, which includes a mobile application program and a door unit. The mobile application program has a first identification code, and includes a scanning sub-program and a receiving sub-program. The door unit includes a camera unit and a two-dimensional code generation unit for capturing a first image and producing a two-dimensional code, where a second identification code is encoded in the two-dimensional code. The first image and the second identification code are transmitted to a cloud server. On the other hand, the second identification code may be obtained by the scanning sub-program through scanning the two-dimensional code. The first and second identification codes are transmitted by the mobile application program to a pairing unit of the cloud server for matching and authentication. When the first and second identification codes match, the cloud server sends the first image and the second identification code to the receiving sub-program for visual confirmation and an electronic lock may be unlocked if the first image shows no stranger.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
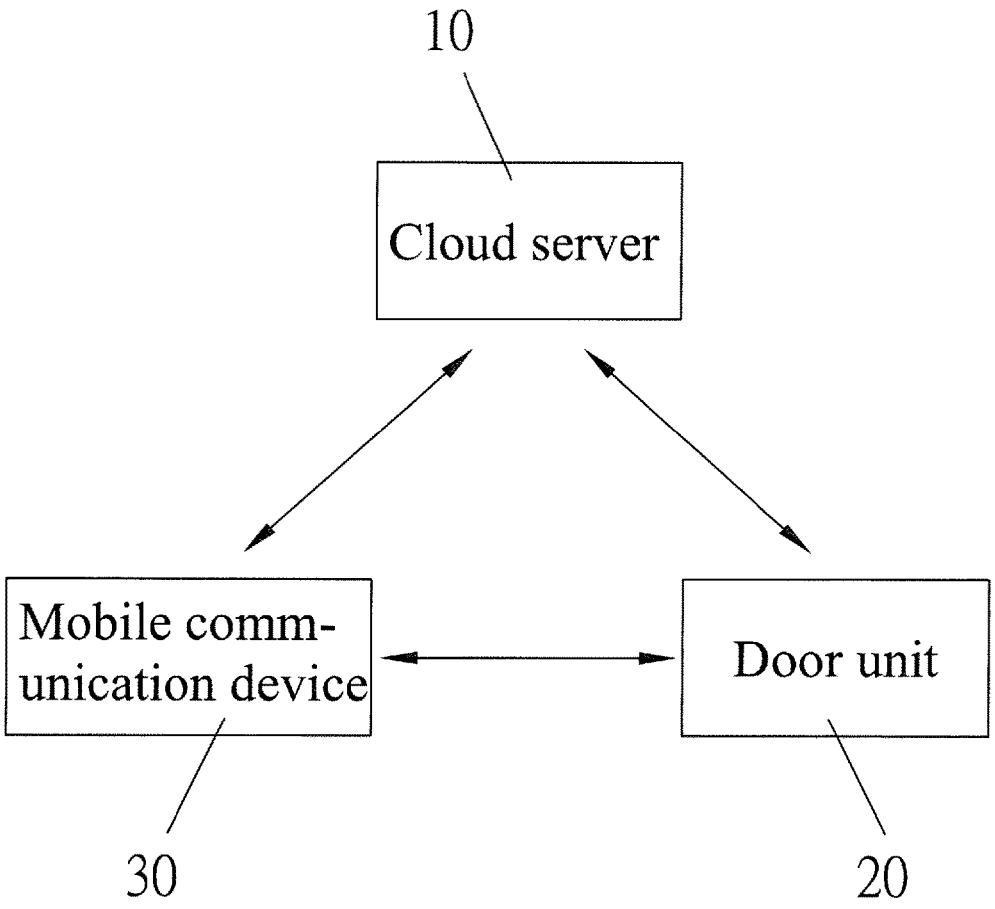
FIG. 1 is a functional block diagram showing a cloud-based access control system according to a first embodiment of the present invention.

As shown in FIG. 1, a cloud-based access control system according to a first embodiment of the present invention includes at least a cloud server 10, at least a door unit 20, and a mobile communication device 30.

Figure 2:
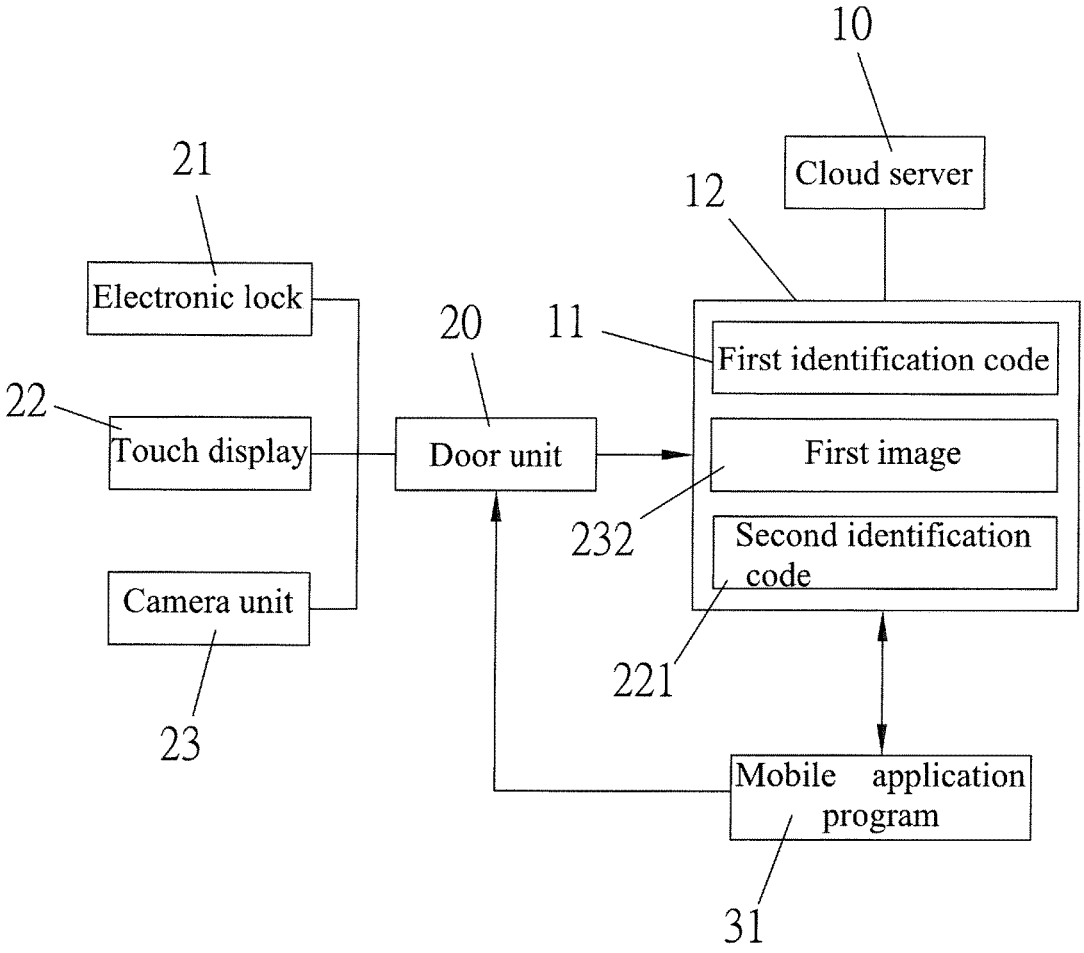
FIG. 2 is a schematic diagram showing interaction within the cloud-based access control system of FIG. 1.
Figure 3:
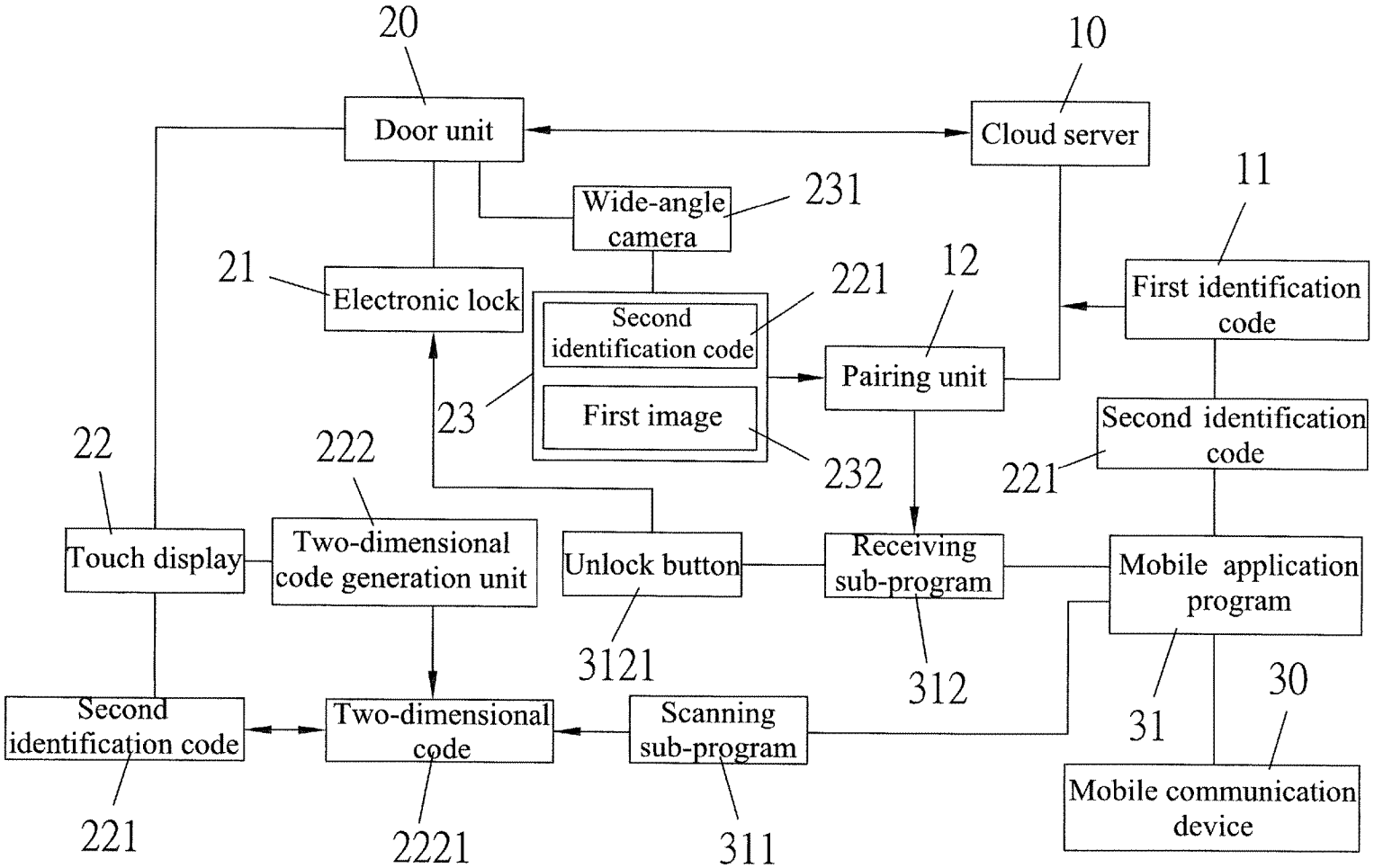
FIG. 3 is a schematic diagram showing a flow of data within the cloud-based access control system of FIG. 1.

As shown in FIGS. 1 to 3, multiple residents make registration to the cloud server 10 and each resident is assigned a first identification code 11. The cloud server 10 includes a pairing unit 12.

As shown in FIG. 2, each door unit 20 is data-linked with the cloud server 10, and includes at least an electronic lock 21, at least a touch display 22, and at least a camera unit 23. The touch display 22 has a second identification code 221 matching the first identification code 11 and includes two-dimensional code generation unit 222. The camera unit 23 includes a 180-degree wide-angle camera 231 so that everything in front of the door unit 20 may be captured. The first and second identification codes 11 and 221 are produced and paired when a resident makes registration to the cloud server 10. The first and second identification codes 11 and 221 then may be paired and authenticated by the pairing unit 12.

A mobile application program 31 is installed in the mobile communication device 30, and is data-linked with the cloud server 10. The first identification code 11 is stored in the mobile application program 31. The mobile application program 31 also provides a scanning sub-program 311 and a receiving sub-program 312. The receiving sub-program 312 provides an unlock button 3121.

The touch display 22 is in a stand-by mode or an advertisement mode when it is not activated. The touch display 22 is activated when the touch display 22 is touched by a resident holding the mobile communication device 30. Then, the camera unit 23 is engaged to capture at least a first image 232. The two-dimensional code generation unit 222 is also engaged to produce a two-dimensional code 2221 where the second identification code 221 is encoded. The door unit 20 then transmits the first image 232 and the second identification code 221 to the pairing unit 12.

When the two-dimensional code 2221 is produced, it may be scanned by the scanning sub-program 311 to extract the second identification code 221. The first and second identification codes 11 and 221 are both transmitted to the pairing unit 12 by the mobile application program 31. If the first and second identification codes 11 and 221 are matched and authenticated, the cloud server 10 transmits the first image 232 and the second identification code 221 to the receiving sub-program 312. The resident then confirms the first image 232 and clicks the unlock button 3121 to unlock the electronic lock 21.

Figure 4:
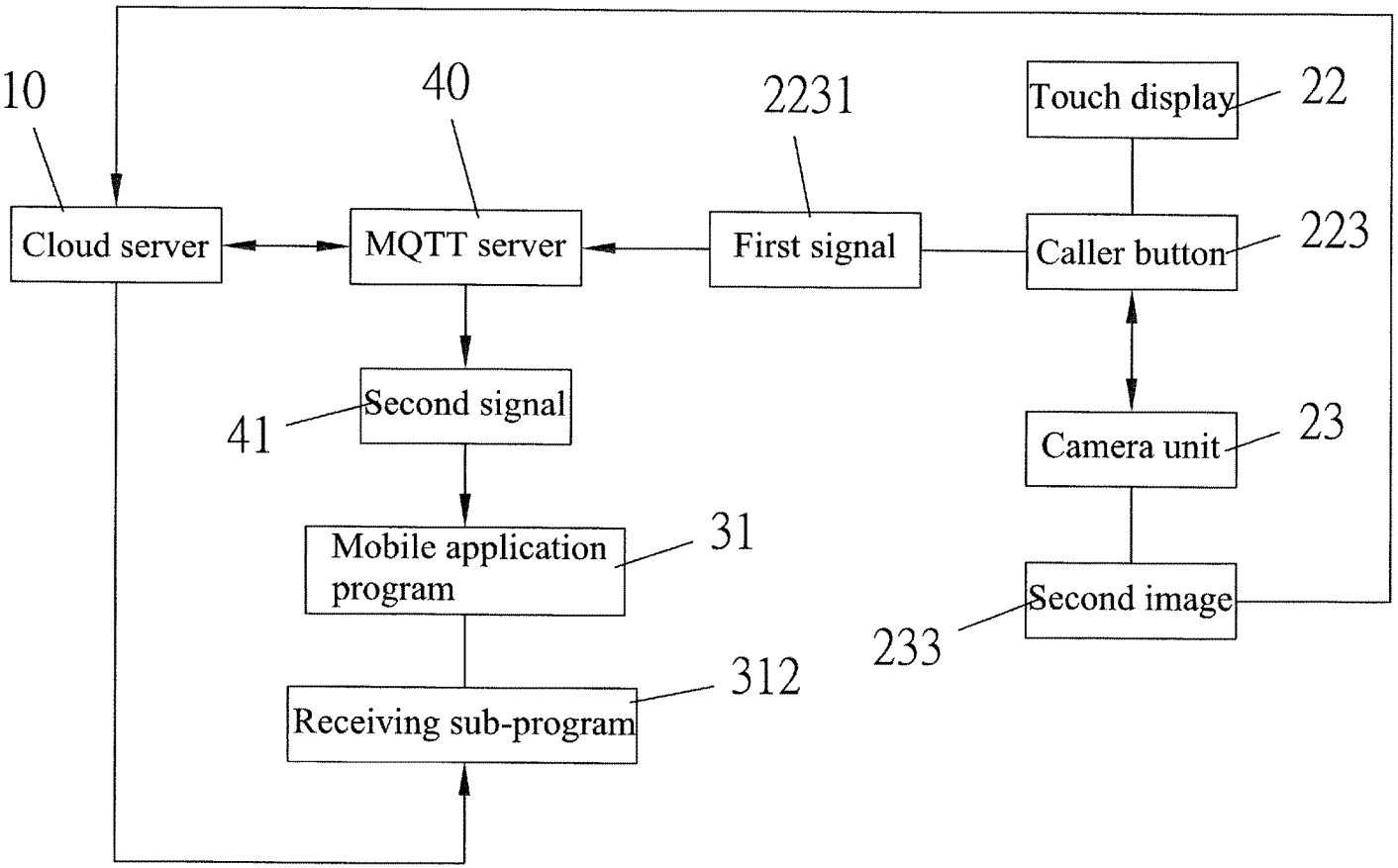
FIG. 4 is a schematic diagram showing a flow of data within the cloud-based access control system of FIG. 1 with a MQTT server.

As shown in FIG. 4, the cloud-based access control system further includes a Message Queuing Telemetry Transport (MQTT) server 40 data-linked with the cloud server 10 and the mobile application program 31. The touch display 22 provides at least a caller button 223 for, when engaged, transmitting at least a first signal 2231 to the MQTT server 40. Upon receiving the first signal 2231, the MQTT server 40 transmits a second signal 41 to the mobile application program 31 to notify the resident.

The caller button 223 is linked with the camera unit 23. When the caller button 223 is engaged, the camera unit 23 captures a second image 233, which is delivered to the receiving sub-program 312 through the cloud server 10. The resident as such may examine the second image 233. If the second image 233 shows that the caller button 223 is engaged by a known visitor, the resident may engage the unlock button 3121 to unlock the electronic lock 21.

In other words, the MQTT server 40 is for notifying a resident that a visitor is at the door unit 20. Then, regardless whether the resident is at home, the resident may be notified by receiving the second signal 41 from the MQTT server 40 by the mobile application program 31. The MQTT server 40 relies on the second identification code 221 to obtain a corresponding first identification code 11 from the cloud server 10, and then notifies the mobile application program 31 with the first identification code 11.

When there is a visitor calling on a resident (or a resident forgets to bring his/her mobile communication device 30), the caller button of the door unit 20 is operated to notify the resident (or other people of the same household). After verifying the second image 233, the electronic lock 21 is unlocked to allow entrance. If a stranger is shown on the second image, the resident may choose not to unlock the electronic lock 233.

Figure 5:
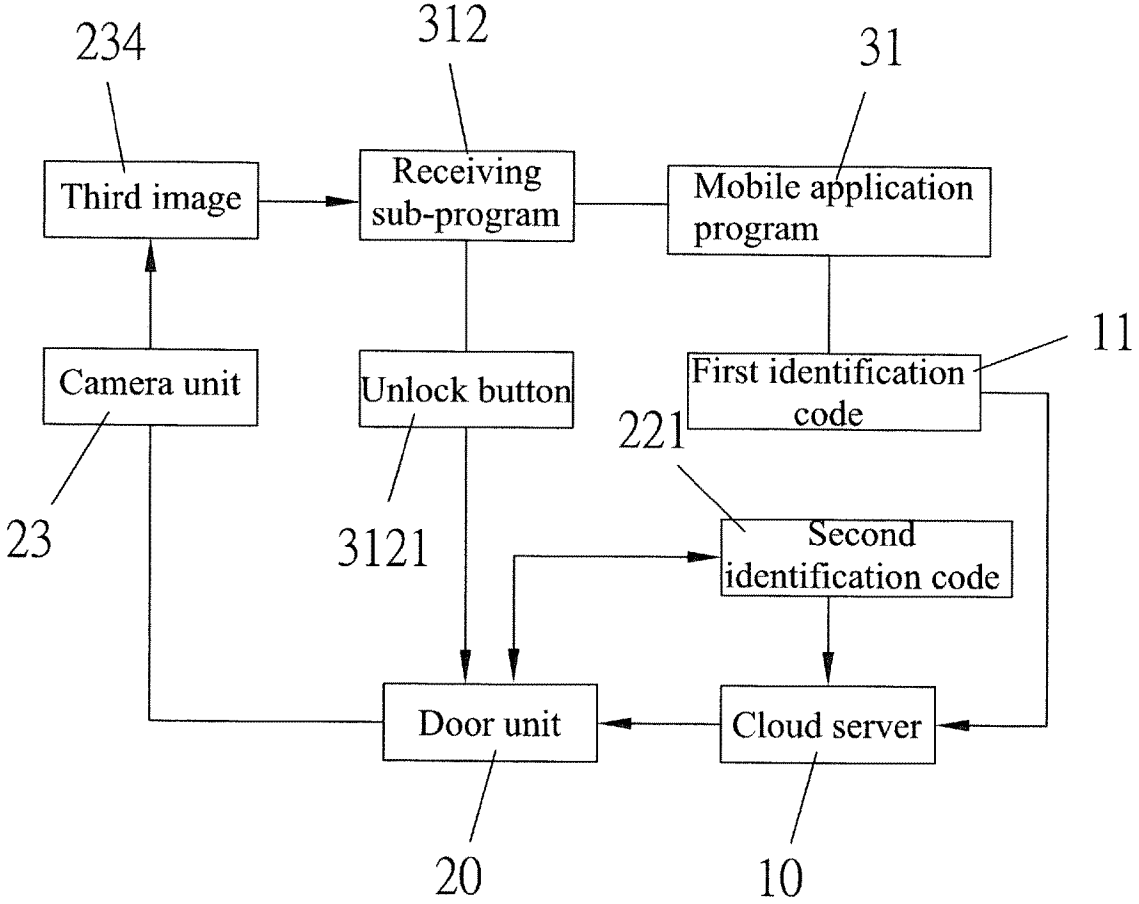
FIG. 5 is a schematic diagram showing a flow of data within the cloud-based access control system of FIG. 1 when a resident proactively unlocks an electronic lock.

As shown in FIG. 5, the mobile application program 31 transmits the first identification code 11 to the cloud server 10 and the cloud server thereby is able to identify the matched second identification code 221, and then to activate the corresponding door unit 20. The camera unit 23 of the door unit 20 then captures at least a third image 234, which is sent to the receiving sub-program 312 of the mobile application program 31 through the cloud server 10. The resident therefore may inspect the third image 234 and selectively unlock the electronic lock 21.

The above scenario happens when a visitor calls on a resident by himself/herself. For example, the visitor informs the resident that he/she is already at the door unit 20 by telephone or through network. The resident uses the mobile application program 31 to link with the door unit 20 with the corresponding second identification code 221 to active the camera unit 23. In the meantime, the mobile application program 31 transmits the first identification code 11 to the cloud server 10. On the other hand, the third image 234 captured by the camera unit 23 is delivered to the receiving sub-program 312 of the mobile application program 31 through the cloud server 10 so that the resident may examiner the third image 234 and selectively unlock the electronic lock 21.

Figure 6:
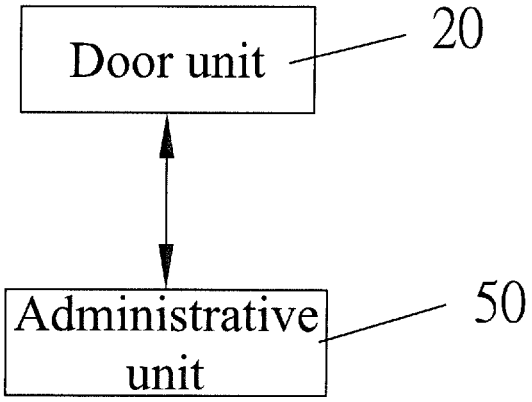
FIG. 6 is a schematic diagram showing how a visitor may call a security guard through a door unit data-linked with an administrative unit of the cloud-based access control system of FIG. 1.

As shown in FIG. 6, the door unit 20 may be data-linked with an administrative unit 50 operated by a security guard. The electronic lock 21 may be unlocked also by the security guard through the administrative unit 50.

Figure 7:
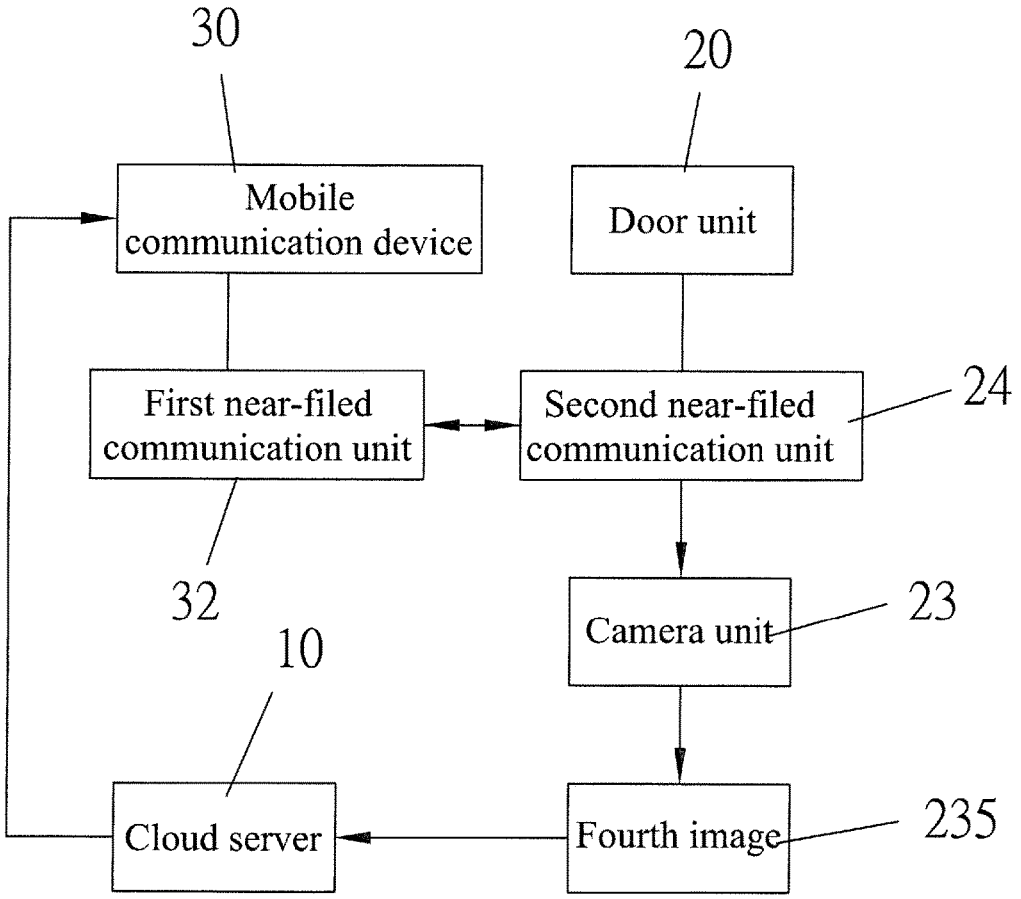
FIG. 7 is a functional block diagram showing a cloud-based access control system according to a second embodiment of the present invention.

FIG. 7 provides a second embodiment of the present invention which is generally identical to the second embodiment and the description to the identical parts is omitted.

The mobile communication device 30 and the door unit 20 further include a first near-filed communication (NFC) unit 32 and a second NFC unit 24, respectively. The first and second NFC units 32 and 24 have the first and second identification codes, respectively. When the mobile communication device 30 and the door unit 20 are at close proximity, the first and second NFC units 32 and 24 sense each other so that the camera unit 23 is activated to capture a fourth image 235. The fourth image 235 is delivered to the mobile application program 31 through the cloud server so that the resident may inspect the fourth image 235 and unlock the electronic lock 21 selectively.

Figure 8:
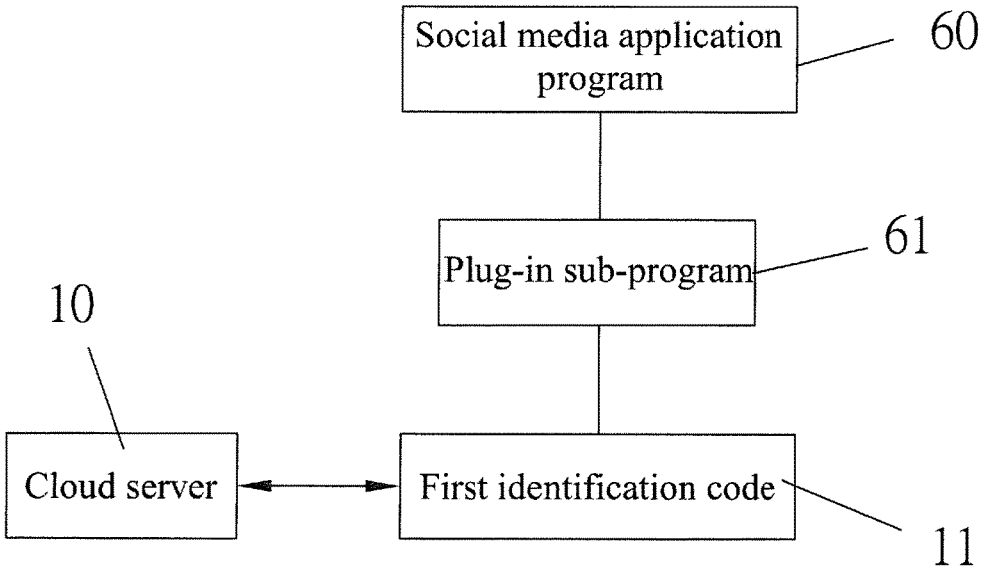
FIG. 8 is a functional block diagram showing a cloud-based access control system according to a third embodiment of the present invention.

FIG. 8 provides a third embodiment of the present invention which is generally identical to the previous embodiments and the description to the identical parts is omitted.

In this embodiment, the mobile application program 31 may be implemented as a plug-in sub-program 61 to a social media application program 60. Therefore, a resident may operate the door unit 20 to unlock conveniently from within the social media application program 60.

For example, the social media application program 60 may be the WeChat application program widely popular in China, and the plug-in sub-program 61 is a plug-in component supported by WeChat to add additional feature to the existing WeChat functionality. Therefore, the resident may select and execute the plug-in sub-program 61, which is the mobile application program 31, directly from WeChat, which is a convenient option to the resident.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A cloud-based access control system for a community of residents, comprising:

a cloud server for the residents to make registration, where each resident is assigned a first identification code, and the cloud server comprises a pairing unit;

at least a door unit where the door unit is data-linked with the cloud server, and comprises at least an electronic lock, at least a touch display, and at least a camera unit, the touch display has a second identification code matching the first identification code and comprises a two-dimensional code generation unit, the touch display is activated when touched by a resident, the camera unit then is engaged to capture at least a first image, the two-dimensional code generation unit is engaged to produce a two-dimensional code with the second identification code encoded, and the door unit transmits the first image and the second identification code to the pairing unit;

a mobile communication device comprising a mobile application program data-linked with the cloud server, where the first identification code is stored in the mobile application program, the mobile application program comprises a scanning sub-program and a receiving sub-program, the receiving sub-program provides an unlock button, the second identification code is obtained by the scanning sub-program through scanning the two-dimensional code, the first and second identification codes are transmitted by the mobile application program to the pairing unit, and, when the first and second identification codes match, the cloud server sends the first image and the second identification code to the receiving sub-program for visual confirmation, and the resident selectively unlocks the electronic lock.

2. The access control system according to claim 1, further comprising a Message Queuing Telemetry Transport (MQTT) server data-linked with the cloud server and the mobile application program; wherein the touch display provides at least a caller button that, when engaged, transmits at least a first signal to the MQTT server; upon receiving the first signal, the MQTT server transmits a second signal to the mobile application program to notify the resident.

3. The access control system according to claim 2, wherein the caller button is linked with the camera unit; and, when the caller button is engaged, the camera unit captures a second image, which is delivered to the mobile application program through the cloud server for the resident to examine the second image to selectively unlock the electronic lock.

4. The access control system according to claim 1, wherein the mobile application program transmits the first identification code to the cloud server; the cloud server identifies a matched second identification code, and then activates a corresponding door unit; the camera unit of the door unit captures at least a third image, which is sent to the mobile application program through the cloud server for the resident to examine the third image and selectively unlock the electronic lock.

5. The access control system according to claim 1, further comprising an administrative unit, wherein the door unit is data-linked with the administrative unit, the administrative unit is operated by a security guard to selectively unlock the electronic lock.

6. The access control system according to claim 1, wherein the camera unit comprises a 180-degree wide-angle camera.

7. The access control system according to claim 1, wherein the mobile communication device and the door unit further comprises a first near-filed communication (NFC) unit and a second NFC unit, respectively; the first and second NFC units are at close proximity, the first and second NFC units sense each other and activate the camera unit to capture a fourth image; the fourth image is delivered to the mobile application program through the cloud server so that the resident inspects the fourth image and unlocks the electronic lock selectively.

8. A cloud-based access control system for a community of residents, comprising:

a cloud server for the residents to make registration, where each resident is assigned a first identification code, and the cloud server comprises a pairing unit;

at least a door unit, where the door unit is data-linked with the cloud server, and comprises at least an electronic lock, at least a touch display, and at least a camera unit, the touch display has a second identification code matching the first identification code and comprises a two-dimensional code generation unit, the touch display is activated when touched by a resident, the camera unit then is engaged to capture at least a first image, the two-dimensional code generation unit is engaged to produce a two-dimensional code with the second identification code encoded, and the door unit transmits the first image and the second identification code to the pairing unit;

a mobile communication device comprising a social media application program, where the social media application program comprises a mobile application program as a plug-in sub-program to the social media application program, the mobile application program is data-linked with the cloud server, the first identification code is stored in the mobile application program, the mobile application program comprises a scanning sub-program and a receiving sub-program, the receiving sub-program provides an unlock button, the second identification code is obtained by the scanning sub-program through scanning the two-dimensional code, the first and second identification codes are transmitted by the mobile application program to the pairing unit, and, when the first and second identification codes match, the cloud server sends the first image and the second identification code to the receiving sub-program for visual confirmation, and the resident selectively unlocks the electronic lock.

9. The access control system according to claim 8, further comprising a Message Queuing Telemetry Transport (MQTT) server data-linked with the cloud server and the mobile application program; wherein the touch display provides at least a caller button that, when engaged, transmits at least a first signal to the MQTT server; upon receiving the first signal, the MQTT server transmits a second signal to the mobile application program to notify the resident.

10. The access control system according to claim 9, wherein the caller button is linked with the camera unit; and, when the caller button is engaged, the camera unit captures a second image, which is delivered to the mobile application program through the cloud server for the resident to examine the second image to selectively unlock the electronic lock.

11. The access control system according to claim 8, wherein the mobile application program transmits the first identification code to the cloud server; the cloud server identifies a matched second identification code, and then activates a corresponding door unit; the camera unit of the door unit captures at least a third image, which is sent to the mobile application program through the cloud server for the resident to examine the third image and selectively unlock the electronic lock.

12. The access control system according to claim 8, further comprising an administrative unit, wherein the door unit is data-linked with the administrative unit, the administrative unit is operated by a security guard to selectively unlock the electronic lock.

13. The access control system according to claim 8, wherein the camera unit comprises a 180-degree wide-angle camera.

14. The access control system according to claim 8, wherein the mobile communication device and the door unit further comprises a first near-filed communication (NFC)

unit and a second NFC unit, respectively; the first and second NFC units are at close proximity, the first and second NFC units sense each other and activate the camera unit to capture a fourth image; the fourth image is delivered to the mobile application program through the cloud server so that the resident inspects the fourth image and unlocks the electronic lock selectively.

15. The access control system according to claim 3, wherein the camera unit comprises a 180-degree wide-angle camera.

16. The access control system according to claim 4, wherein the camera unit comprises a 180-degree wide-angle camera.

17. The access control system according to claim 5, wherein the camera unit comprises a 180-degree wide-angle camera.

18. The access control system according to claim 10, wherein the camera unit comprises a 180-degree wide-angle camera.

19. The access control system according to claim 11, wherein the camera unit comprises a 180-degree wide-angle camera.

20. The access control system according to claim 12, wherein the camera unit comprises a 180-degree wide-angle camera.

* * * * *